US006922155B1

(12) United States Patent
Evans et al.

(10) Patent No.: US 6,922,155 B1
(45) Date of Patent: Jul. 26, 2005

(54) INFORMATION DISPLAY BOARD

(75) Inventors: Garrett L. Evans, Cleveland Heights, OH (US); Kenneth A. Roll, Oberlin, OH (US); Kevin A. Roll, Aurora, OH (US)

(73) Assignee: Travel Boards, Inc., Cleveland Heights, OH (US)

( * ) Notice: Subject to any disclaimer, the term of this patent is extended or adjusted under 35 U.S.C. 154(b) by 0 days.

(21) Appl. No.: 09/491,255

(22) Filed: Jan. 26, 2000

Related U.S. Application Data

(63) Continuation-in-part of application No. 08/808,051, filed on Feb. 28, 1997, now abandoned, which is a continuation of application No. 08/588,100, filed on Jan. 18, 1996, now abandoned, which is a continuation of application No. 08/328,951, filed on Oct. 24, 1994, now abandoned, which is a continuation-in-part of application No. 08/043,190, filed on Apr. 6, 1993, now abandoned.

(51) Int. Cl.[7] ..... G08G 1/09
(52) U.S. Cl. ..... 340/825.28; 340/905
(58) Field of Search ..... 715/748; 340/825.28, 340/825.29, 825.55, 825.19, 3.7, 3.71, 5.9, 5.91, 286.08, 990, 905, 995, 525; 379/93.22, 102.01, 93.17; 345/12, 748; 706/55; 705/6, 5; 701/200; 235/381

(56) References Cited

U.S. PATENT DOCUMENTS 3,614,727 A 10/1971 Fritts
4,255,619 A 3/1981 Saito
4,359,631 A * 11/1982 Lockwood et al. ..... 235/381
4,491,690 A 1/1985 Daley
4,720,849 A 1/1988 Tayama
4,752,876 A 6/1988 Couch et al.
4,805,119 A 2/1989 Maeda et al.
4,905,163 A 2/1990 Garber et al.
4,922,439 A 5/1990 Greenblatt
5,021,961 A 6/1991 Ross et al.

OTHER PUBLICATIONS

Two page letter dated Apr. 9, 1992 to Ohio Turnpike Commission.
Two page letter dated Jun. 23, 1992 to Ohio Turnpike Commission.
One page letter dated Jul. 17, 1992 from Ohio Turnpike Commission to Garrett Evans.
Pages from Triphone, Inc. brochure, copyright 1986.
Supplemental Disclosure Statement filed in parent U.S. Appl. No. 08/808,051, filed Jul. 6, 1993.

* cited by examiner

*Primary Examiner*—Edwin C. Holloway, III
(74) *Attorney, Agent, or Firm*—Watts, Hoffmann, Co. LLP

(57) ABSTRACT

An information display board system especially adapted for use by travelers and tourists along an interstate highway. The display board is located at a rest stop or other location readily accessible by road travelers and displays a map of the road along which it is positioned and a listing of hotels/motels, points of interest and other lodgings in the region. ID/status indicators are provided which illuminate in one color, i.e., green, to indicate room availability and illuminate in a different color, i.e., red, to indicate room unavailability. Road alert indicators are positioned along the road map and are selectively illuminated to indicate delays or other road conditions. The illumination of the ID/status and road alert indicators are remotely changeable by hotel operators and the road authority, by directly calling a board manager. The board manager includes communication hardware in the form of a programmable computer and telephone control circuitry. A board manager receives information from the hotel operators and road authority as well as a central operator and controls the updating of the display boards via the communication hardware. Background information about the hotels and road locations can also be entered by the central operator and stored in the computer for later display to the operator.

14 Claims, 11 Drawing Sheets

INFORMATION DISPLAY BOARD

CROSS-REFERENCE TO RELATED APPLICATION

The present application is a continuation-in-part of U.S. Ser. No. 08/808,051 to Evans et. al., entitled "Information Display Board", filed Feb. 28, 1997, now abandoned, incorporated herein in its entirety by reference, which is a continuation application of U.S. Ser. No. 08/588,100, filed Jan. 18, 1996, now abandoned, which is a continuation application of U.S. Ser. No. 08/328,951 filed Oct. 24, 1994, now abandoned, which is a continuation-in-part application of U.S. Ser. No. 08/043,190 to Evans et al. entitled "Information Display Board" filed Apr. 6, 1993, now abandoned, incorporated herein in its entirety by reference.

TECHNICAL FIELD

The present invention relates generally to devices for displaying changeable information, and in particular, to a display board for displaying travel-related information such as lodging facility availability, road conditions, etc., the information being updatable from remote locations. More particularly, the present invention relates to a control system for operating travel display boards.

BACKGROUND ART

During the course of travel, both business travelers and tourists traveling by motor vehicle are often in need of information regarding travel routes to their respective destination or destinations, road and weather conditions en route from their present location to their destination. The traveler may also require information concerning food and lodging including restaurant location and hours of operation, lodging facility availability, location, cost, amenities, etc. A tourist may desire information on regional tourist attractions and points of interest. Those traveling by air may desire the aforementioned information as well as information regarding airline schedules and car rental enterprises. For travelers flying into major metropolitan airports, displays are often provided which identify nearby hotels and provide a phone by which the traveler may call a hotel to make or confirm a reservation and to request pick-up by a courtesy car.

Automobile travelers using the interstate road system can often times obtain hotel and/or motel identification and location and other information by means of written material available at rest stops or at the exits of toll roads. Rest areas along some interstates also make information available, usually in the form of pamphlets regarding attractions and other points of interest that are available in the area. Road travelers may also obtain hotel/points of interest information from travel guides published by travel agencies and/or travel clubs. The information contained in these guides, although accurate at the time of publication, may not reflect current conditions nor do they provide any information regarding the availability of accommodations at the lodging facilities listed in the guide. Typically, the traveler must phone each of the hotels to make that determination.

DISCLOSURE OF THE INVENTION

The present invention provides a new and improved information display board system especially adapted to provide information to travelers and tourists. In the disclosed embodiment, the display board system is intended to be located at a location accessible by road travelers such as a rest stop along an interstate highway.

In the preferred embodiment, the system includes a display board having a section listing lodging facilities (hotels, motels, bed and breakfast facilities) available in the surrounding region. Associated with each listing is an ID/status indicator which has at least two conditions of illumination. In the preferred embodiment, each indicator comprises a multicolored light assembly in which a light of one color is illuminated to indicate a first status, i.e., green to indicate room availability and a second light of another color, i.e., red is illuminated to indicate room unavailability.

Preferably, when the display board is positioned on at interstate rest stop, the display board illustrates a map of the road depicting the locations of the listed hotels, points of interest, and other lodging information. In the exemplary embodiment, road alert indicators are positioned along the road on the map which the traveler is on. The road alert indicators are selectively illuminated in order to apprise the traveler of road sections where construction or accident delays may be encountered, road conditions are hazardous, etc.

The lodging facility status and road alert indicators are remotely activated and changeable by respective lodging facility operators and road administrators. The display board includes communication hardware including a programmable computer and a telephone line interfaced to the computer. To access the display board information, a lodging facility operator, for example, telephones the display board and, upon entering a predetermined code or password, is given access to the indicator associated with the operator's lodging facility. The lodging facility operator is then able to change the status of his or her associated indicator from red (no vacancy at the lodging facility) to green (vacancy at the lodging facility) or green to red to indicate the change in room availability.

Preferably, the road administrator accesses a predetermined road alert light position in the map section of the display board by calling the display board communication hardware and entering the code or password associated with a particular road alert indicator that the administrator desires to change. Once the administrator has obtained access to the system, he/she can change the status of the selected road alert indicator. In the preferred arrangement, each road alert indicator has two states of operation; illuminated and not illuminated. To activate a preselected road alert indicator, the road administrator calls the display board, enters the code for that particular indicator, and then indicates that its status should be changed from OFF to ON or vice versa.

In the preferred and illustrated embodiment, the display board also includes a second phone line by which a display board administrator may call the board to change a code file containing the list of codes for the lodging facility and road alert indicators which are compared to the data entered by a caller. The code file may be a standard ASCII sequential file stored on a hard disc (or a floppy disc) mounted within the programmable computer. The log file preferably also stores the name of the lodging facility and its ID number which corresponds to a number displayed for that lodging facility on the display board. Other information for each lodging facility, road alert indicator or other point of interest may also be stored in the code file. In addition, the communication system maintains a log of transactions and calls made by lodging facility operators and road administrators and this log file can be transmitted from the display board to the display board administrator via the second phone line.

In the preferred embodiment, the display board mounts a publicly accessible phone by which a traveler can call any of the lodgings or points of interest displayed on the board. The phone preferably includes a lock-out device that prevents persons from making personal calls on the phone.

According to another feature of the board, a changeable message display is located on the board by which time, date, weather conditions, etc. can be displayed. In the preferred embodiment, this message display is coupled to its own phone line by which messages are remotely updated.

In another embodiment of the instant invention the display board system is a free standing structure including two uprights supporting a center member. The free standing display board system center member includes a map display depicting the highway or road along which the display board is located and the surrounding area. The map includes a plurality of road alert indicator lights which are spaced along the depicted highway (and possibly along certain major intersecting highways or roads). The road alert indicator lights have two states, preferable red and green, red indicative a possible delay in that section of the highway and green indicative of normal conditions.

The display board additionally includes a listing of area attractions and points of interest each having an associated with a two state indicator light indicating whether the facility is open or closed and a listing of lodging facilities each also having an associated with a two state indicator light indicating vacancy or no vacancy conditions at the facility.

A programmable computer and communications hardware and software is provided to permit tourist attraction managers, lodging operators and road administrators to change the status of indicator lights for their respective facilities/roads via a telephone call to the display board from their own respective remote locations.

The display board system additionally includes one or move telephones for travelers to place calls to the listed lodging facilities and attractions/points of interest. The display board phone has associated with it three status indicators lights controlled by the display board programmable computer. The status indicator lights are selectively lit to convey information to the traveler using the display board phone to call one of the listed lodging facilities. A log of display board phone calls made or attempted to be made to the lodging facilities is also maintained.

Supported by the display screen uprights are two touch screen video displays and respective regional maps. The touch screen displays are controlled by a programmable computer which accesses a data file storing information regarding various tourist attractions and points of interest. The traveler interacts with a touch screen display to request information. Data responsive to the traveler's inquiry will be selected from the data file and presented to the tourist.

Additionally, the display board system includes a changeable message display. The display may advantageously be used to provide weather related information which is downloaded to the display board programmable computer from a computerized database providing service. The touch screen displays may also be used to display weather information.

The self-standing travel board also includes a cellular/car phone information response and call forwarding system which receives calls from travelers calling the display board via car or cellular phones and provide information concerning lodging facilities at a selected location (e.g., a selected freeway exit). In response to a travelers request the system will patch the traveler through to a selected lodging facility. A computer is provided to control the phone information response and call forwarding system and will receive data from the display board programmable computer regarding lodging facility status.

In a preferred embodiment of the invention, a board management system controls the operation of the display board.

The board management system maintains status files on the lodging facilities and road conditions as well as log files of all board activity. In addition, the board management system controls the communication of information from the status files to the individual travel boards using a travel board status file and a modem bank with an automatic dialing process. The board management system may include means to collect and store information about individual lodging facilities and turnpike milepost locations. The board management system may allow for centralized control and access to the status files and remote control and access via modem communication.

Additional features of the invention will become apparent and a further understanding obtained by reading the following detailed description made in connection with the accompanying drawings.

BEST MODE FOR CARRYING OUT THE INVENTION

Figure 1:
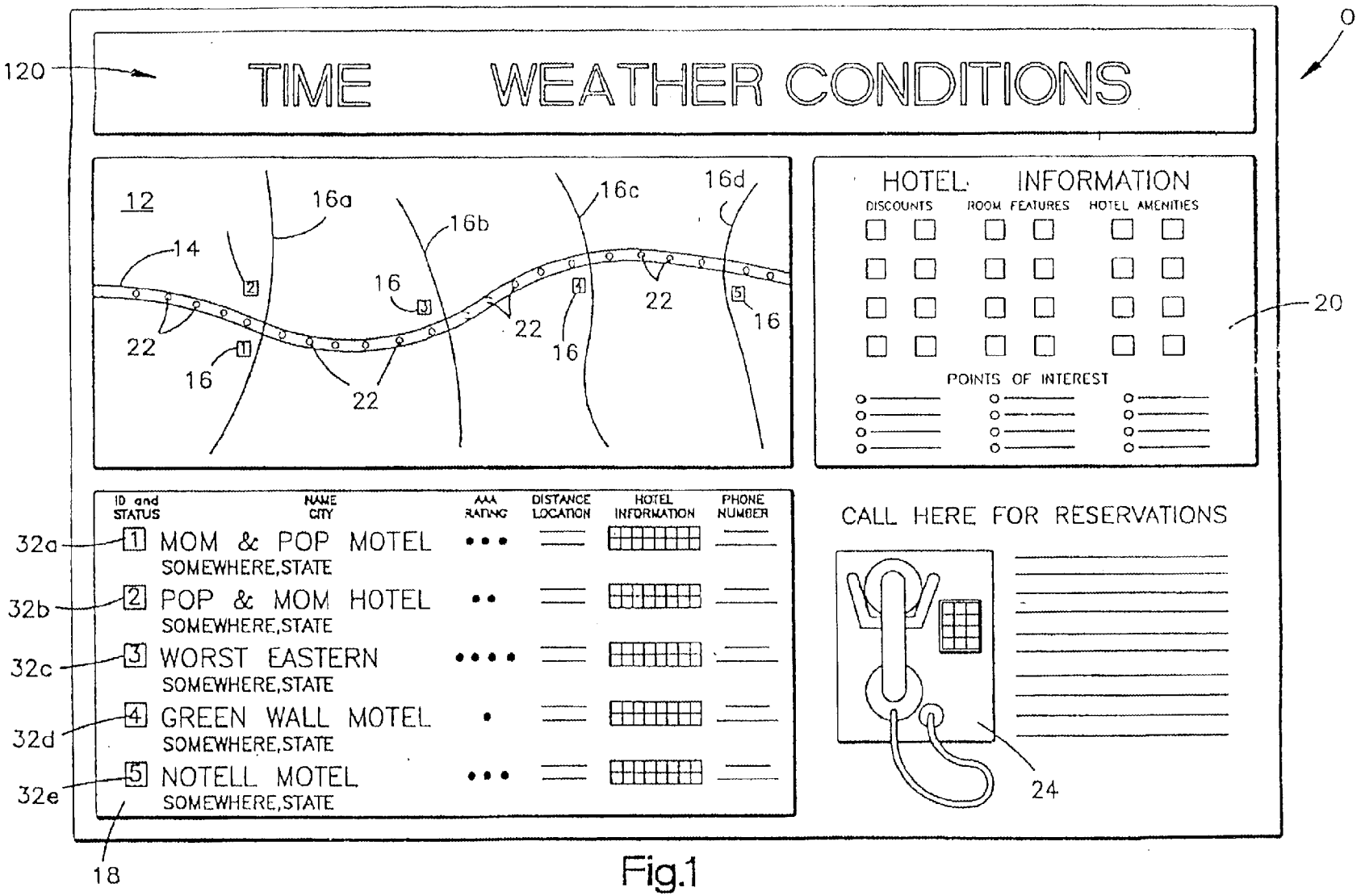
FIG. 1 illustrates an information display board system constructed in accordance with the preferred embodiment of the invention.

Referring first to FIG. 1, a display board 10 is illustrated which embodies the features of the present invention. The invention will be described in connection with an application involving the placement of the illustrated display board at a service plazas and/or rest areas which are commonly found along interstate highways. It should be understood, however, that the present invention is not limited to this type of application and can also be used, for example, at airports and other locations where travelers are likely to need access to travel-related information such as hotel accommodations.

In the illustrated embodiment, the display board 10 includes a map section 12 which display a map of the region, including a depiction of the road on which the traveler/tourist is traveling. The map may also illustrate the positions of crossroads 16*a*–16*d* to provide points of reference. The map displays the locations of hotels/motels which are all designated generally by the reference character 16. As can be seen, the actual hotels/motels are identified by numerical identifiers labeled 1–5. These identifiers correspond to a hotel listing which is displayed in a section 18 located, in the illustrated embodiment, immediately below the road map section 12. As can be seen, the numerals 1–5, indicated by the reference characters 16, correspond to, five motels that are located near and accessible via the road 14. ID indicators may also be provided to show the locations of attractions such as amusement parts or other points of interest such as monuments, parks etc.

The hotel listing section 18 also contains information regarding the hotel such as its phone number, its distance from the rest area at which the display board is located, as well as travel club rating information, etc. A separate hotel information section 20 may also display other information for each of the hotels such as the availability of discounts, room features and hotel amenities.

In the illustrated embodiment, the display board section 20 also includes a listing of points of interest and attractions along the interstate. The points of interest information may include, not only a description of the point of interest, but also its mileage from the display board, phone number, hours of operation, etc.

The display board 10 also includes a phone 24 by which a traveler may directly call one of the identified hotels to make a reservation or to obtain additional information. In the preferred embodiment, the phone includes a "lock out" feature and can only be used to call one of the identified hotels and points of interest or toll-free numbers. Calls to any other numbers are prevented.

The map section 12 may also provide information to the traveler regarding road conditions along the road 14. Road alert indicators, preferably in the form of lights or LEDs 22, are positioned along the roadway which, when lit, indicate that delays may be encountered in that region due to road construction, weather conditions and/or accidents. The road alert LEDs are preferably spaced all along the road depiction 14 at equal intervals, i.e., ten miles. One or more of these LEDs are illuminated to delineate the stretch of road where delays may be experienced.

Figure 2:
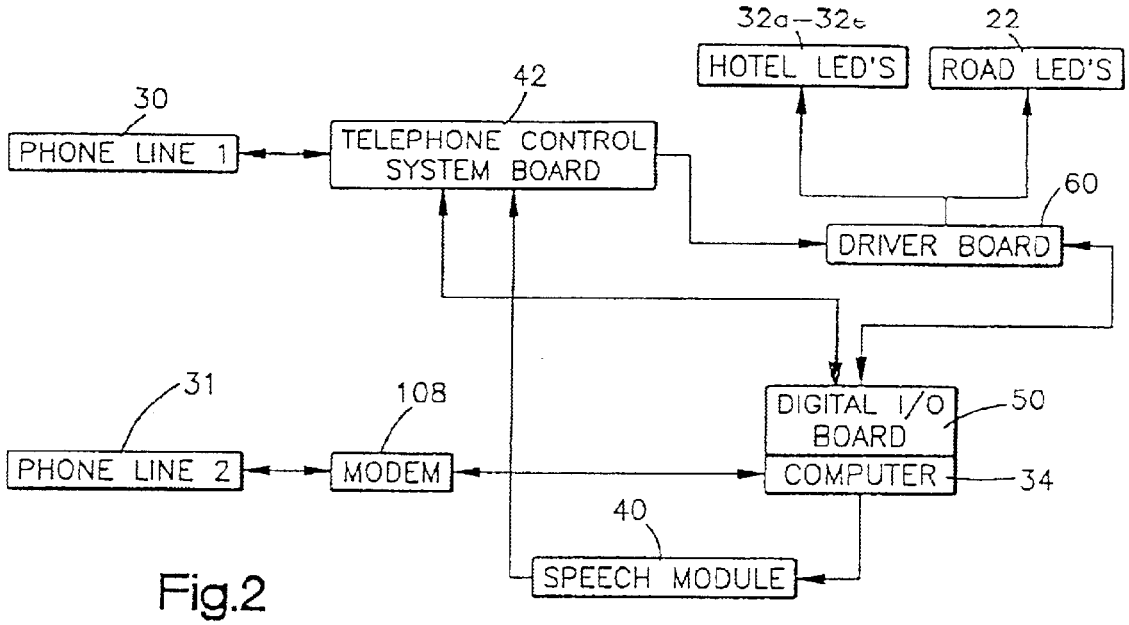
FIG. 2 illustrates, in block diagram, the hardware used to access, update and communicate with the display board shown in FIG. 1.

Turning now to FIG. 2, the hardware for remotely controlling and accessing the display board is illustrated. In the exemplary embodiment, two separate phone lines are used to access the display board.

One of the phone lines is used by the hotel operators and road authority to access and modify information displayed on the board, whereas the second phone line is used by a display board administrator for the purpose of changing hardware parameters, uploading and downloading data, such as passwords, etc. The phone line used by hotel operators and the road authority is indicated by the reference character 30, whereas the phone line used by the display board administrator is indicated by the reference character 31.

Phone line #1 (indicated by the reference character 30) is used by the hotel operators to update or change the status display forming part of the hotel listing section 16. A lighted ID/status indicator forms a part of each hotel/motel's listing in the display board section 18. The respective ID/status indicators are designated by the reference characters 32*a*–32*e* and are preferably two-color LED assemblies. Preferably, each ID/status indicator 32*a*–32*e* includes both green and red LEDs. To indicate that accommodations are available at a given hotel, the green LEDs are activated so that the corresponding ID/status indicator glows green. To indicate that accommodations are unavailable, the green LEDs are turned off and the red LEDs are activated. The illumination state of the hotel ID/status indicators is controlled remotely by the hotel operator. In order to change a given indicator light from red to green or vice versa, the hotel operator phones the display board via phone line #1. As will be explained below, hardware and software associated with the display board and connected to phone line #1, answers the hotel operator's call. Using a menu system forming part of the display board hardware and software, the hotel operator can instruct the hardware to change the status, i.e., the color of the ID/status indicator associated with that hotel.

The hardware illustrated in FIG. 2 is preferably located at or near the display board 10. It includes a personal computer 34 which in the illustrated embodiment is what is known as an IBM AT Compatible Computer. The computer preferably includes 640K of random access memory, at least one floppy drive, and a 40M hard disk drive. A computer having less capability can also be used for this application.

A speech module 40 is connected to and/or may be placed within the computer itself. A suitable speech module is commercially available from Covox of Eugene, Oreg. and is identified as a Covox Model STPC-P0-273 module. This device is conventional and is generically known as an enunciator which, as is known, may convert a string of ASCII characters into audible speech.

The phone line 30, speech module 40 and computer 34, interface to a telephone control system board 42 which is commercially available from Moose Industries. In the illustrated embodiment, a telephone control system board sold under the Model No. MPI-280 may be used.

This particular board is modified in a conventional way to perform the functions needed by the display board. This board, as delivered, includes its own microprocessor which is not needed since the board is being interfaced to a computer 34. To adapt the board for this application, the microprocessor is removed and six signal lines are taken from the microprocessor socket and connected to a digital I/O board 50. In the disclosed embodiment, the board 42 includes a known microprocessor in the Motorola 68000 family. Literature and data sheets regarding the microprocessor and its printouts are readily available from the manufacturer and other sources in order to determine which pins to connect the six signal lines which are more fully described below.

This board 42 includes DTMF decoding circuitry which is used to detect tones sent by a caller along the phone line the tones are generated by the caller by pressing one of the twelve keys forming part of a typical touch tone phone pad. A given tone is detected and then translated into BCD (Binary Coded Decimal). This BCD signal is sent by four signal lines connected between the microprocessor socket in the telephone control board 42 and the digital I/O board 50. Two additional signal lines are connected between the microprocessor socket and digital I/O board 50. One signal line is used by the telephone control board 42 to inform the computer 34 via the digital I/O board 50 that the phone is ringing. The other signal line is used by a computer to command the telephone control system board 42 to answer the call.

The computer is also interfaced to circuitry for activating the various hotel indicators 32*a*–32*e* and the road alert indicators 22 by means of the digital I/O board 50. In the exemplary embodiment, the digital I/O board 50 constitutes a commercially available board from Computer Boards, Inc. and is sold under the model identifier no. CI0-DI096.

The disclosed digital I/O board 50 provides only TTL level signals. These signals are incapable of directly lighting the hotel ID/status LEDs 32*a*–32*e* or the road alert indicators 22. It should be understood that the blocks 32*a*–32*e*, 22 labeled "Hotel LEDs" and "Road LEDs" schematically represent all of the hotel indicators and road LEDs. The hotel ID/status LEDs and road alert LEDs are actually individual LED displays located on the display board 10. In order to provide signal levels sufficient to selectively illuminate the hotel and road LEDs, a driver board 60 is provided. The driver board 60 uses conventional technology and acts as a current amplifier for signals received from the TTL level digital I/O board 50. The driver board 60 itself may contain a series of conventional components forming Darlington pairs for lighting individual LEDs upon receiving a signal from the digital I/O board 50.

The telephone control system board 42 is electronically coupled to the digital I/O board and hence to the computer. When the display board is called via phone line 1, the telephone control system board 42 provides a signal to the computer to indicate that the phone is ringing. The computer under the control of software represented in block diagram form in FIGS. 3A, 3B instructs the telephone system control board 42 to answer the phone.

Upon answering, the computer instructs the speech module 40 to "say" a salutation such as "Hello. Welcome to the hotel advisory board. Please enter your hotel code now." The caller must then enter an appropriate hotel code or password using a touch tone phone. As is conventional, the telephone system control board 42 is able to detect and translate the tones received from the caller and converts it into data recognizable by the computer 34. The computer checks the received data against a "code file" stored within the computer to determine whether the code entered by the caller matches any of the stored entries. If no match is found, the software instructs the speech module to emit a suitable message such as "I'm sorry, the code you entered is invalid. Please re-enter your hotel code." In the preferred control, the caller is given three tries to enter a valid code before the computer instructs the speech module to emit a suitable message such as "I'm sorry. Please verify that you are using the correct hotel code. Thank you for calling." After this message the computer 34 terminates the phone connection between the caller and the display board.

Figure 3A:
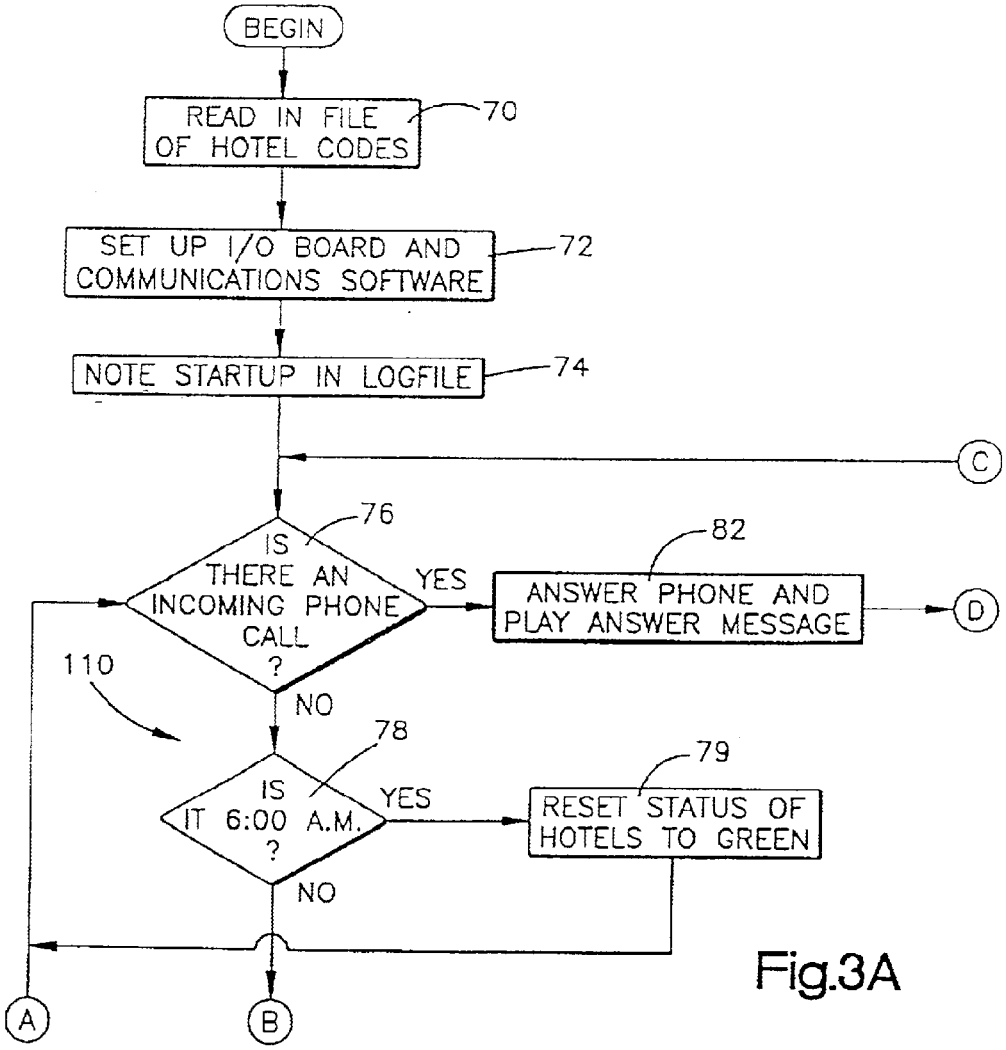
FIGS. 3A and 3B illustrate, in flow chart form, software operating in a computer which forms part of the hardware shown in FIG. 2 that performs the necessary functions and controls the communication from a remote location with the display board.
Figure 3B:
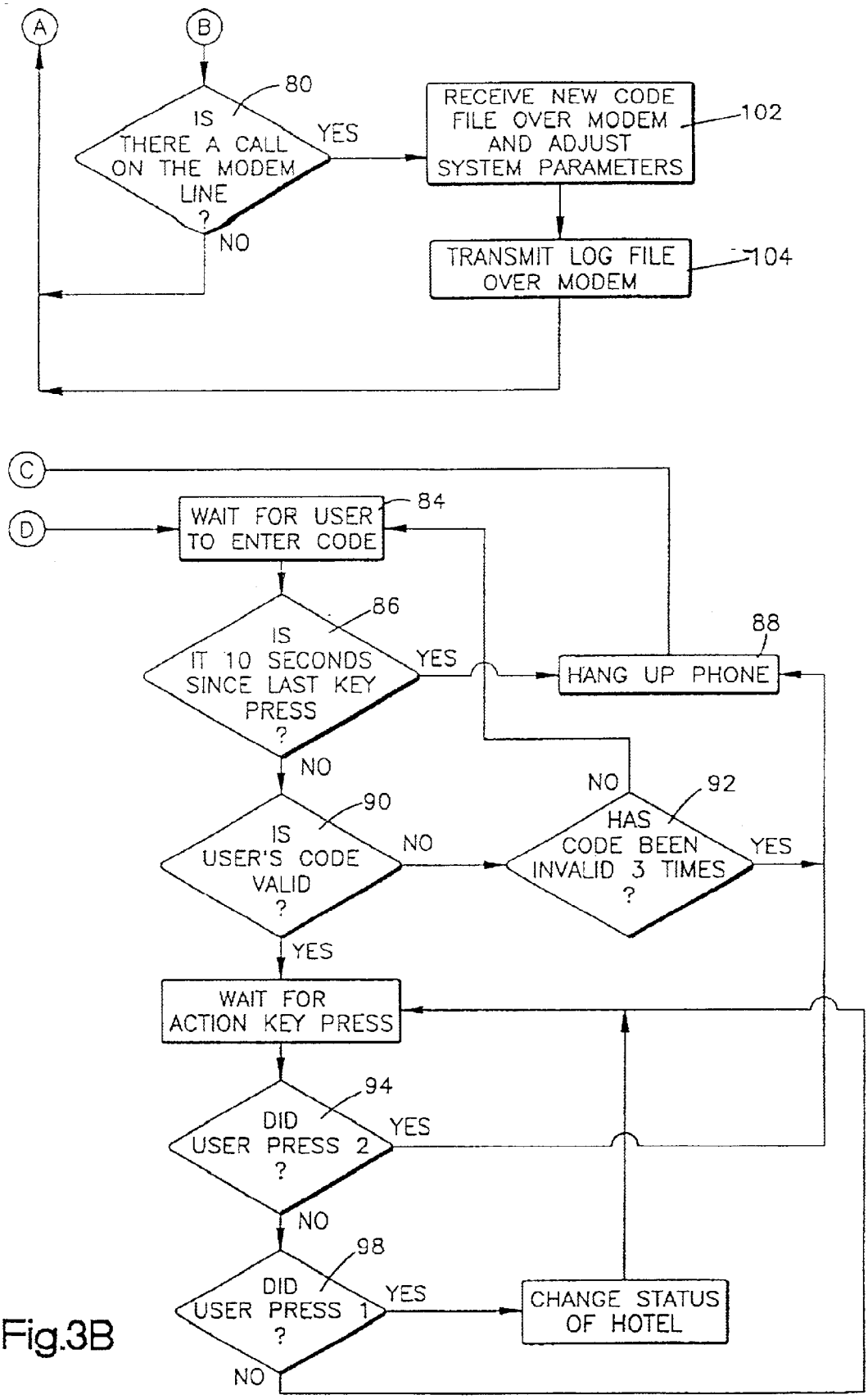

Referring to FIGS. 3A, 3B, other functions performed by the software running in the computer 34 will be explained. Upon start-up of the system, the software reads in a file of hotel codes as indicated by the block 70. The software then initializes the I/O board 50 and loads in, if necessary, communication software for interfacing the computer with the telephone line Block 72. Preferably, the time and date of start-up is noted in a log file that is maintained within the computer 34 (see block 74). Following this initial start-up sequence, the software then monitors signals from the telephone system control board 42 to determine the presence of an incoming phone call. If an incoming call is not detected (decision block 76), the software branches to decision block 78 and checks whether a predetermined "reset" time has been reached. For example, the system may check whether it is 6:00 a.m. and if this condition is found to be true, all of the hotel ID/status indicators 32*e*–32*a* are reset to the "green" condition to indicate room availability (block 79). This features eliminates the necessity of each hotel operator to call the display board each day to reset the indicator from red to green. Following the decision block 78, the system checks for the presence of an in coming phone call on the second phone line 31 decision block 80. The action that occurs when a phone call on the line 31 is detected will be explained below. The software loops through the steps or blocks 76, 78, 80 continuously until an incoming call is detected.

As indicated above, if the telephone system control board 42 informs the computer 34 that the phone line 30 is ringing, the computer instructs the board 42 to answer the phone and then instructs the speech module 40 to emit a salutation (block 82). The software then waits for the user to enter an identifying code or password (block 84). The system monitors the wait period (decision block 86) and if user does not enter any information for a predetermined length of time, i.e., ten seconds, the system instructs the telephone system control board 42 to hang up the phone (instruction block 88). If a code is entered by the caller, the system compares (decision block 90) the entered code with codes stored in a previously stored hotel code file located within the computer. If a match is not found, the software then checks whether the user has made three attempts to enter the code (decision block 92). If three unsuccessful attempts have been made, the software branches to the control block 88 and instructs the telephone system control board 42 to hang up the phone. If less than three attempts have been made, the software instructs the speech module to emit a suitable error message such as "I'm sorry. The code you entered is invalid. Please reenter your hotel code."

If a valid user code is entered, the software then retrieves the current status information for the calling hotel from a status file stored in the computer 34 and sends the information to the speech module 40 along with instructions which converts the message or data into an audible transmission such as "The status is green. Enter 1 to change the status. Enter 2 to exit the system." The software then monitors the telephone system control board 42, waiting for the caller to press either a 1 or 2 at his phone. If the caller presses a 1 (decision block 98), the software sends an appropriate signal to the digital I/O board to change the state of the appropriate LED assembly from green to red or red to green, depending on its existing state. The state of the LED is also then stored in a status file forming part of the computer. Following the change in status, the software executes the status message via the enunciator or speech module to inform the caller that "The status is red. Enter 1 to change the status. Enter 2 to exit the system." The system then waits for the caller to enter a "2" (decision block 94) whereupon the system instructs the telephone system control board to hang up the phone.

The software also includes a time-out function so that if the caller does not enter information for a predetermined length of time, the software also instructs the telephone system control board 42 to hang up the phone. A separate control block is not shown but would be similar to the function performed by the control block 86.

A similar arrangement is used to activate or de-activate the road alert LEDs 22 positioned along the road. To turn ON or turn OFF a road alert LED, the road authority or other agency calls the display board 10, via the first phone line 30.

In the illustrated embodiment, each road alert LED has its own code associated with it, much like each hotel. Upon entering an appropriate code or password, the system recognizes that the caller is to have access to a particular road alert LED. Using a menu system, and by pressing keys on his/her phone, the caller de-activates or activates the selected LED 22 positioned along the road 14, depicted on the map section 12 of the display board 10. To activate or deactivate other road alert LEDs, the road authority caller must enter the code for each LED, which if appropriately entered, will give access to that LED to the caller. Preferably, the road alert LEDs are of a different color than the hotel ID/status indicators so that they are easily distinguishable on the display board.

In the illustrated board, only hotel ID/status and road alert indicators 32*a*–32*e*, 22 are illustrated. It should be understood, however, that the display board may also mount ID/status indicators for points of interest and attractions. These points of interest and attraction indicators may also have multiple illumination levels in order to indicate hours of operation, closing due to weather conditions, overcrowding, etc. Indicators for attractions and points of interest would be accessible in the same way that the hotel ID/status and road alert indicators are accessed. Each would have a code associated with it which, if entered by a caller, would provide access and the ability to change the status of its' illumination.

The display hardware interface also includes a modem 100 connected to the second phone line 31. This phone line 31 is intended to be used by a display board administrator to effect the administrative functions at the board. For example, the phone line 31 is used to download modified code files to the computer should a change in hotel codes be necessary (block 102). In addition, the phone line 31 is used to upload a log file maintained by the computer which contains information regarding activity and performance of the system (control block 104).

Referring to FIGS. 3A, 3B, the software includes a communications portion which directly interfaces with the modem 100 which is typically connected to a conventional RS-232 serial port on the computer. This port is continually monitored by the detection loop (indicated generally by the reference character 110), and when a call at the modem 100 is detected, the system causes the modem to answer the line and to download a new code file from the administrator (control block 102). The code file in the illustrated embodiment, is an ASCII sequential file stored on the hard disk of the programmable computer 34. The log file contains an entry for each hotel/motel. Each entry preferably includes the name of the hotel, a unique code which the caller must enter to gain access to the associated indicator and a unique number or other indicator that is displayed on the display board to identify the hotel, point of interest, attraction, etc. For example, the hotel identified as No. 1 on the display board, would have an entry that included the name of the hotel, a unique code that must be entered by the hotel operator and the number 1. By use of the code file, the identification of hotels, their access codes, and/or their identification numbers can be changed remotely by the board administrator.

Following receipt of the new code file, the current log file, stored in the computer 34, is transmitted to the administrator (control block 104). The administrator may also transmit data for adjusting or changing system parameters (control block 108). When the phone call from the administrator is concluded, the system reverts to the call detection loop 110 to await a phone call on either phone line 2 or phone line 1.

It should be apparent that the present invention provides a relatively cost-efficient method and apparatus for apprising travelers of hotel accommodations and road conditions. The information displayed can be changed directly by the hotel operators using conventional phone lines and inexpensive hardware. The traveler's phone 24 mounted to the display board may be a commercially available secured memory phone which allows a user to call specific phone numbers or toll free numbers only and precludes general use by the public. A phone of this type is commercially available from several sources such as Ceeco of Plantation, Fla.

An upper section 120 of the display board 10 is preferably a changeable message display which can be controlled either locally at the display board or remotely using a phone line.

In the preferred embodiment, the message display 120 is able to store multiple messages and that includes a means for scheduling the display of those messages at periodic times or intervals. The message display 120 may be used to display the date, outside temperature, weather conditions, etc. In addition, the road authority may use the message display to alert motorists as to road conditions and other travel information. In the preferred embodiment, a third phone line is provided by which control of the message display 120 is effected from a remote location. Suitable displays usable in the disclosed application are available from Daktronics, Inc. of Brookings S. Dak. and is designated as INFONET Models 102 and 202. Modems for establishing communication between the display board 120 and an associated phone line are also available from Daktronics, Inc.

The hotel ID/status indicator 32*a*–32*e* may comprise purchased LED assemblies. These assemblies are available from various sources. An LED assembly is sold by the Stanley Company under part no. MU08-9103 has been found to be satisfactory in this application. This particular LED assembly includes multiple LEDs of two different colors. The LEDs of one color are simultaneously energized to indicate one status, while the LEDs of the other color are simultaneously energized to indicate the other status.

The road alert LEDs 22 may also be purchased from standard sources. In particular, an LED assembly sold under part no. MU09-9109 available from the Stanley Company has been found to be suitable.

If ID/status indicators are used for points of interest and attractions, the above identified LED assemblies could be used to perform that function. Other colors for the LEDs may be chosen in order to distinguish points of interest and attraction indicators from the hotel and road alert indicators.

As explained above, the driver board 60 acts as a current amplifier since the TTL level signals on the standard I/O 50 cannot directly illuminate and LED. The driver board-60 includes an LED driver associated with each hotel ID/status indicator and each road alert indicator 22. LED drivers suitable for this application are available from Sprague under part no. ULN2004A.

Figure 4:
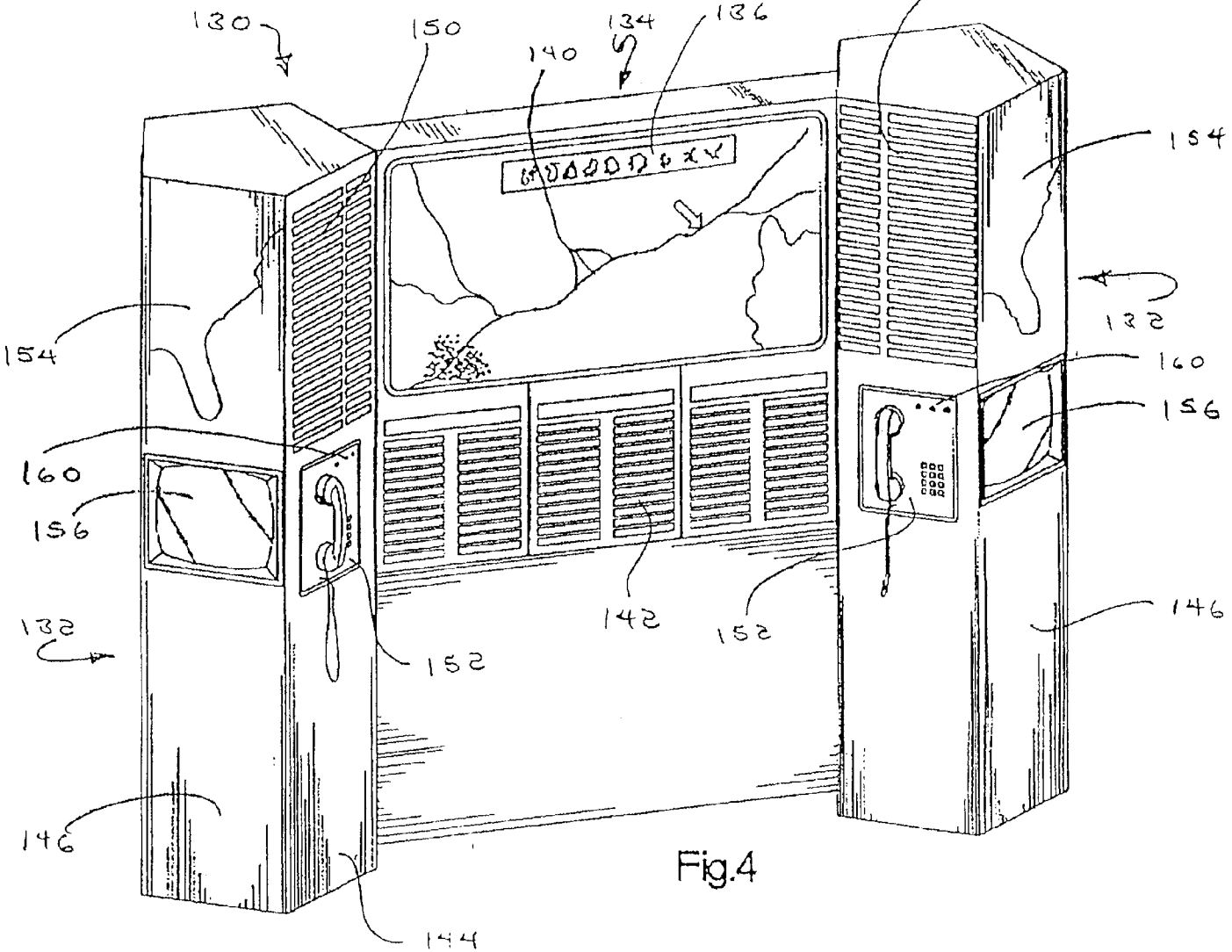
FIG. 4 is an alternate embodiment of a information display board system of the present invention, the display board in FIG. 4 is a free standing system.

An alternate embodiment of the information display board system of the present invention is shown at 120 in FIG. 4. The board system 130 is free standing and includes two upright members 132 spaced apart by a center member 134. The center member 134 supports a changeable message display 136 near the upper portion of the center member. The center member 134 also supports a road map section 138 depicting the road on which the display board system 130 is located. The road map includes road alert indicator lights 140 which are controlled as set forth in the previous embodiment. The center member 134 additionally supports an information panel section 142 displaying information on regional tourist attractions and other points of interest.

Each of the two upright members 132 are comprised of five panels forming a pentagon shape when viewed in cross section. Two of the panels 144, 146 of each upright member 132 support additional informational features. Panels 144 each support a lodging facility listing 150 and a telephone receiver and dialing mechanism 152. Panels 146 each support a regional map section 154 and a touch screen display 156.

Figure 5:
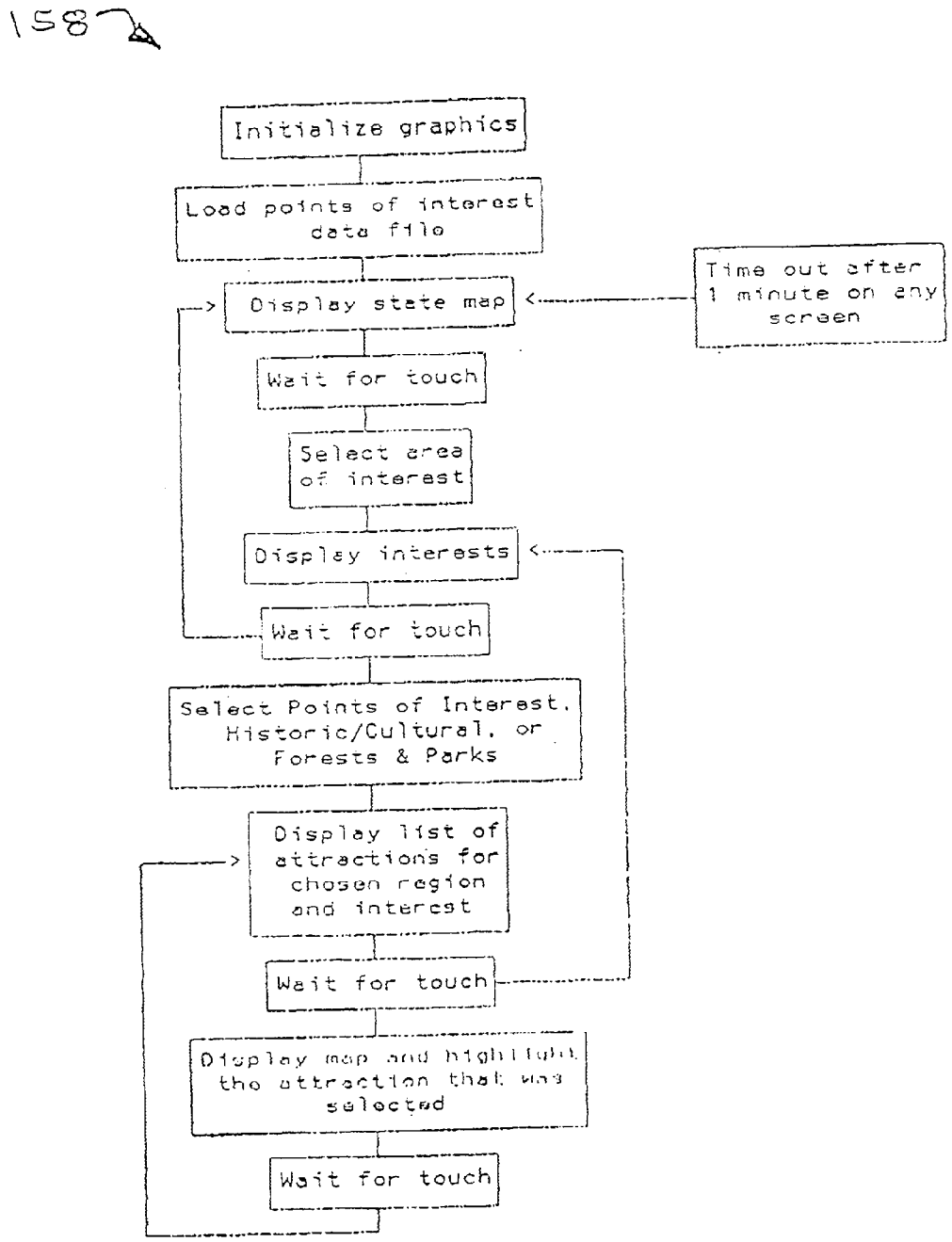
FIG. 5 illustrates a flow chart associated with a touch screen display for displaying information regarding a selected point of interest.

Each of the touch screen displays 156 is part of an independent touch screen displays system. Each system has its own programmable computer (not shown) and touch screen software controller (not shown). The touch screen displays 156 provide information about tourist attractions and points of interest in the area by responding to touches of the screen by the traveler seeking such information. A flow chart 158 detailing the interaction between the traveler and the touch screen display 156 is set forth in FIG. 5. The touch screen display system computers may be any generic computer of the 386SX family with hard and floppy disk drives. The display monitor is preferably a Goldstar 1460SVGA. The touch screen frame and touch screen software controller are available from Carrol Touch.

The touch screen display system computers are of the same type used in the travel board controller except that each has a hard drive, a floppy drive and no modems. The software associated with the video touch screen displays is a sequential paging system which provides data on locations of specific points of interest.

The lodging facility listings 150 include ID numbers and light emitting diode status indicator lights as explained in the previous embodiment. It may be desirable to ensure that a traveler using one of the display board telephones 152 is not precluded from dialing a lodging facility reservation number if the lodging facility the is displaying a status indicator light indicating of no occupancy at that facility. It may also be desirable to indicate the status of the traveler's attempted call to his or her selected lodging facility. These features are implemented through the use of three LEDs 160 (not shown in FIG. 4, but shown schematically in FIG. 7) positioned adjacent the display board phones 152.

Figure 7:
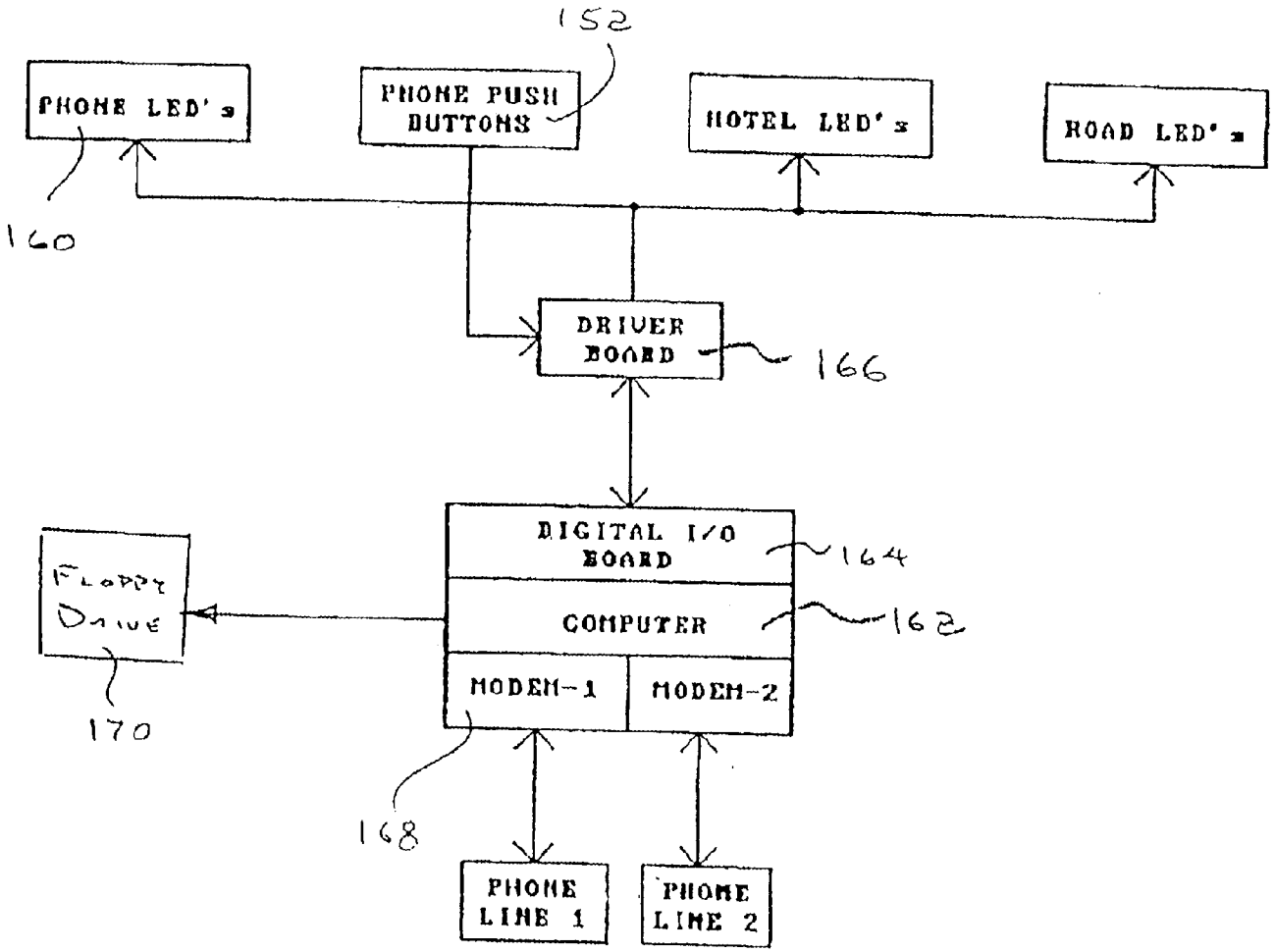
FIG. 7 illustrates, in block diagram, the hardware used to control the light emitting diode status indicator and road alert lights.

Turning to FIG. 7, a personal computer 162, of the type described with respect to the first embodiment, controls all LEDs though a digital input/output board 162 and an LED driver board 164. If a traveler using the phone 152 attempts to call a lodging facility with a indicator status displaying red (no occupancy), a red phone LED is illuminated. If the lodging is displaying an occupancy condition, a second LED light is activated, the LED being yellow in color. The yellow LED light indicates that the traveler's call is in process but not yet connected with the selected lodging facility. When the lodging facility picks up their receiver and the traveler's call is connected to the lodging, the yellow LED light is deactivated and a third LED is activated. The third LED is colored green.

Figure 6:
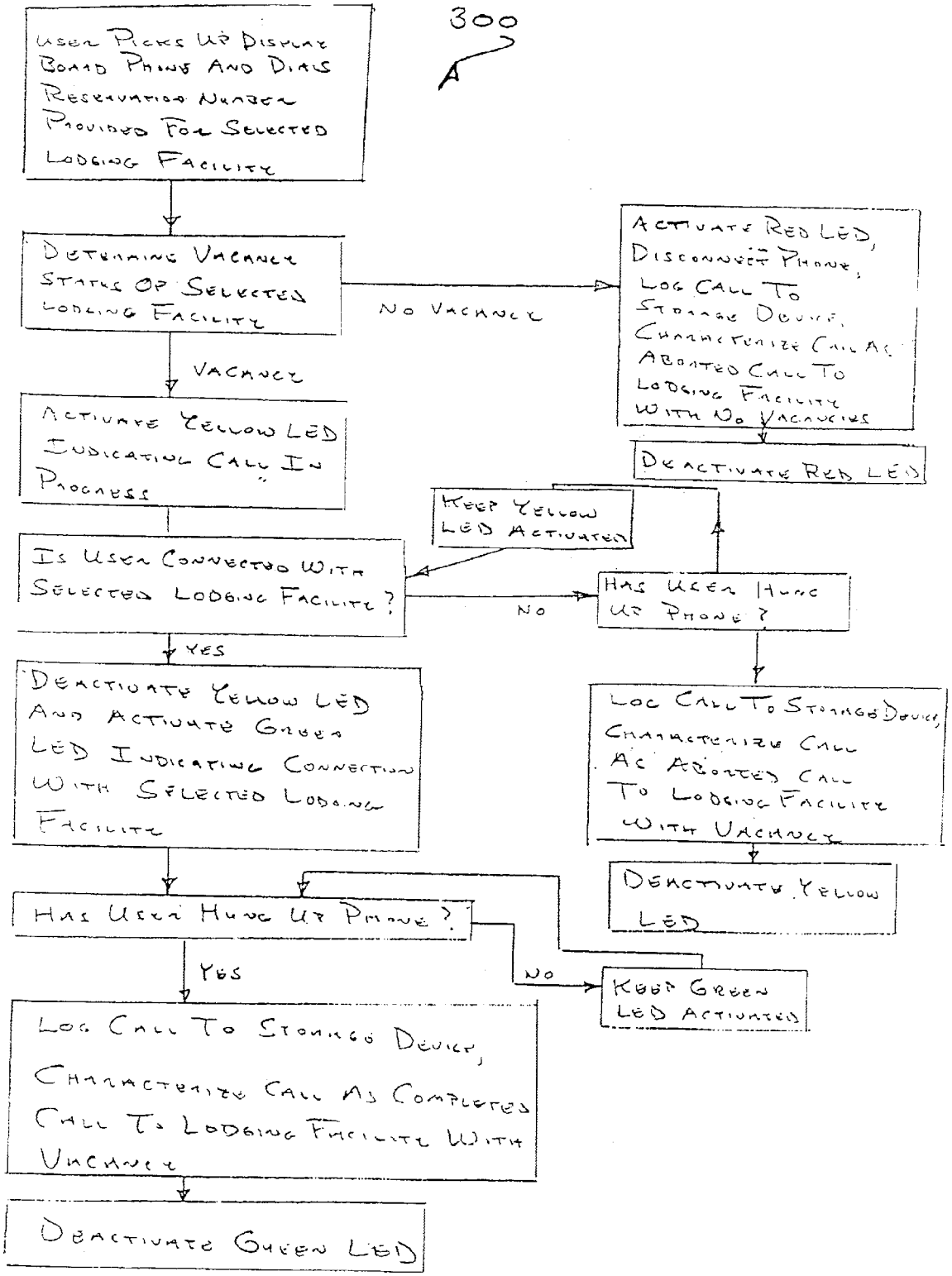
FIG. 6 illustrates a flow chart associated with a set of light emitting diodes providing status information to a traveler using the information display board to reserve lodging.

In addition, a log of all travelers calls, whether completed or not, are recorded on a storage device for future analysis. A flow chart 300 delineating the procedure involved in the phone LED actuation and call logging is set forth in FIG. 6.

The additional components necessary to provide the computer controlled phone system set forth above are shown in FIG. 7 and include a modem 168 to dial the lodging facility reservation number, a floppy drive 170 to record the activity file and a digital input/output board or card 164 to control input and output signals.

As noted above, the self standing display board system 130 includes a changeable message display 136 which comprises a rectangular array of LEDs wherein the messages "roll" across the display, as is well known in the art. It is desirable to display current weather information for the area in which the display board 130 is located on the changeable message display 136 and/or one or both of the touch screen displays 156. Alternately, the weather information may be printed on a printer (not shown) either standing alone or incorporated into the display board 130.

A program is provided which runs on the computer 162. The program automatically calls a computer database information service (for example, CompuServe or another similar vendor) and down load data from the information service for a chosen state. The report is then displayed on the message display and/or the touch screen displays.

Figure 8:
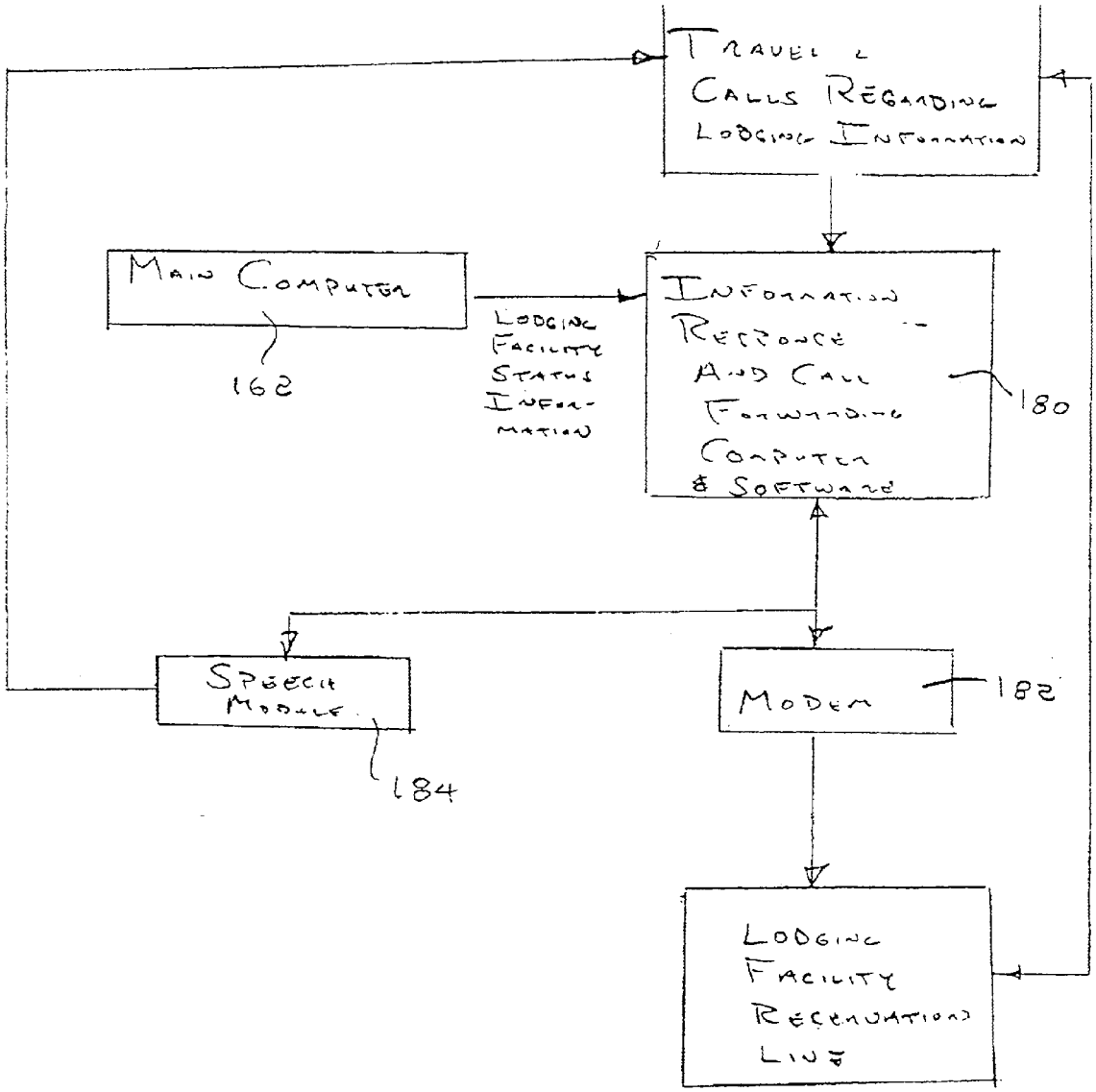
FIG. 8 illustrates a flow chart for an information response and call forwarding system of the display board system of FIG. 4.

Turning to FIG. 8, the self-standing display board system 130 also includes a computer and supporting software 180, a modem 182 and a speech module 184 comprising a information response and call forwarding system for responding to calls to the board from travelers utilizing cellular or car phones and, if the traveler desires, patching the call through the traveler's desired lodging facility reservation line so that accommodations may be reserved.

The computer 180 is preferably a IBM PC-compatible PC which will receive lodging status information from the main display board computer 162 through the computer's parallel port. The system will answer calls from travelers and the speech module will generate speech to prompt the traveler and respond to inquiries in a manner similar to the speech module 40 described in the first embodiment of the display board system 10. The system will provide information about lodging facilities availability. If the traveler desires, the call may be patched through to a lodging facility selected by the traveler.

Figure 9:
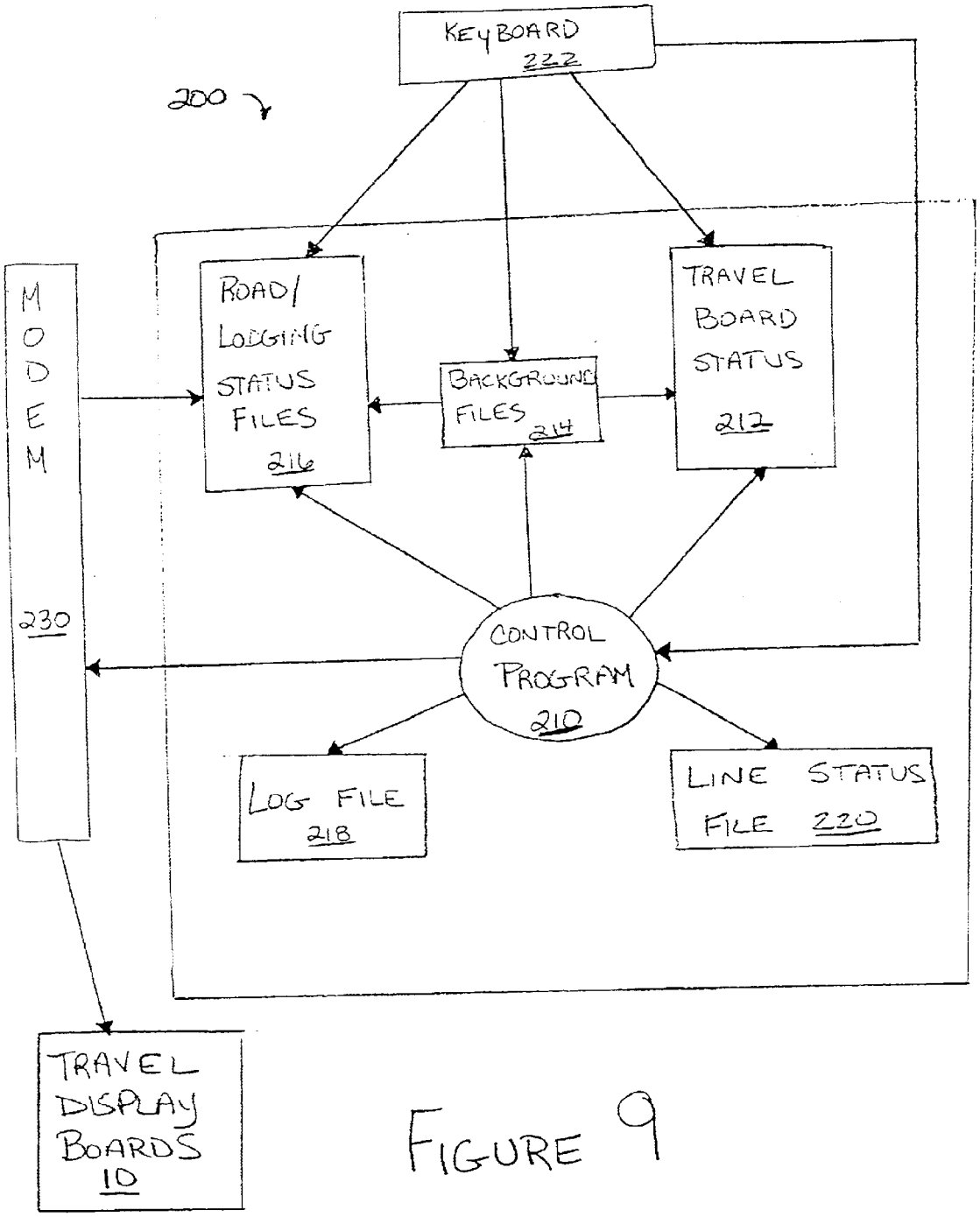
FIG. 9 illustrates a block diagram for a board management system for controlling operation of display boards.
Figure 10:
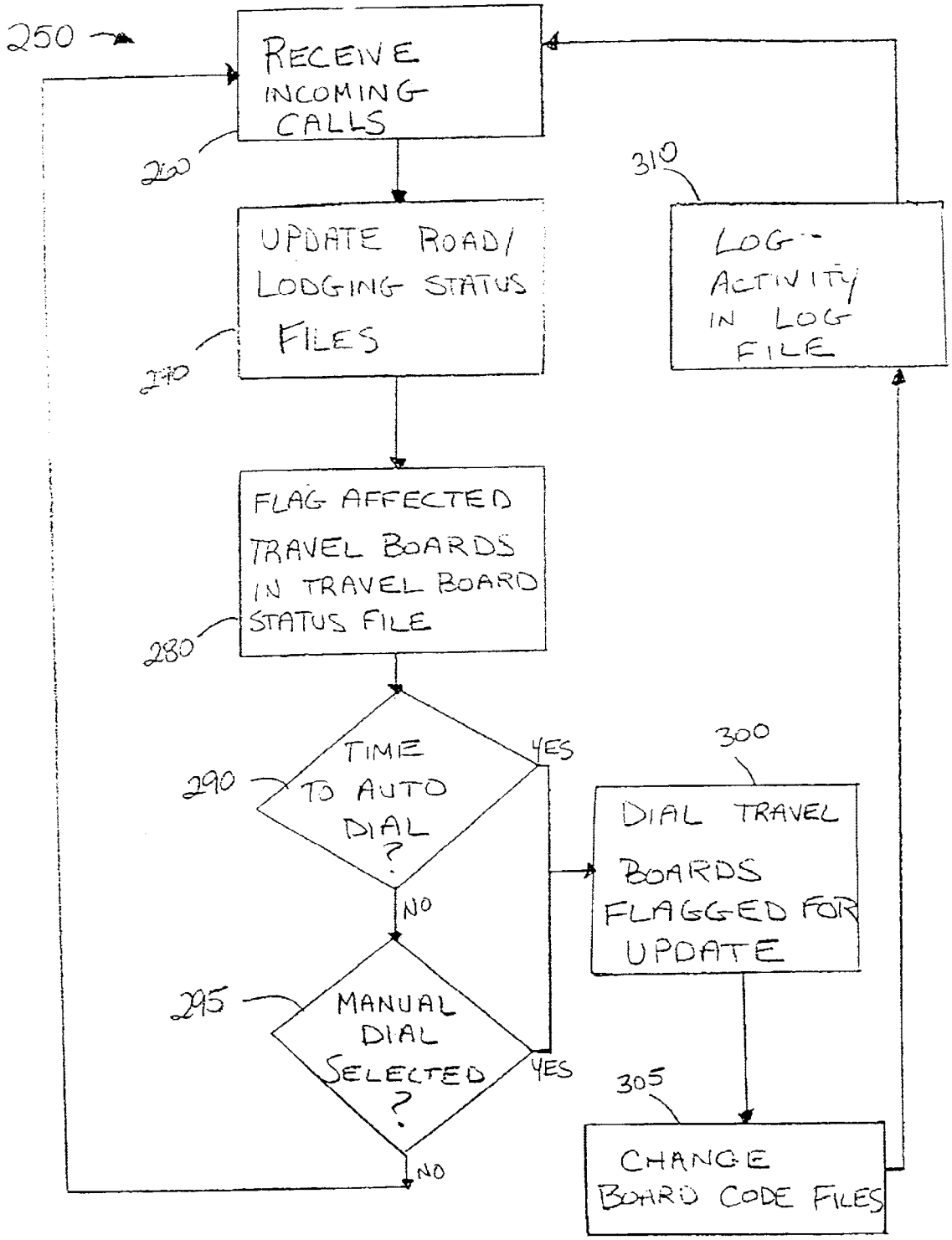
FIG. 10 illustrates a flow chart associated with the board management system of FIG. 9; and, FIG. 11 illustrates another embodiment of an information display board system constructed in accordance with the preferred embodiment of the invention.

FIGS. 9 and 10 illustrate a board management system 200 for use in controlling display board systems. Referring first to FIG. 9, a board management controller 205, such as a computer, is shown. A control program 210 interfaces with various blocks of files including road/lodging status files 216, background information files 214, travel board status files 212, a log file 218, and line status file 220. In addition, the control program controls a bank of modem lines 230 which communicate with the display boards 10 (FIG. 1) in addition to innkeepers and turnpike authority. A keyboard 222 can be used by an operator to access and edit the road/lodging status files 216, the background files 214, and the travel board status file 212. The keyboard 222 may also prompt the control program 210 to activate the modem bank 230 to contact the travel display boards 10. The modem lines 230 may be accessed by innkeepers and turnpike authority to update the road/lodging status files 216.

The control program 210 processes information from the road/lodging status file 216 and updates the travel board status file 212 for use in controlling the modem lines 230. The control program 210 performs a periodic update of travel display boards by contacting the boards on the modems 230. The control program 210 maintains the log file 218 by storing every communication and operation which occurs in the operation of the display boards chronologically. The control program also updates the phone line status file 220 with information about the current condition of each phone line (not shown) associated with the modem lines 230. The control program 210 controls a user terminal (not shown) to provide a visual interface for an operator to update the road/lodging status files 216, the background files 214, and the travel board status file 212.

To maintain the road/lodging status files 216, the control program 210 provides a list (viewable on the user terminal) of all milepost locations and lodging locations with background information about each location along with a status indicator corresponding to the current status (such as vacancies or traffic difficulties) of the milepost or lodging location. The status indicator can be changed either by a remote caller via the modem 230 or by an operator at the terminal using the keyboard 222. If a status is changed, the control program 210 accesses the travel board status file and flags all affected travel boards to be dialed (and updated) during the next update cycle. Commands may also be entered using the keyboard 222 to initiate a manual dialing of all travel boards 10 which are flagged to be dialed in the travel board status file 212. Background information about each lodging and milepost location can be entered into the background files 214 via the keyboard 222. In addition, new locations may be added via the keyboard 222.

The control program 210 displays the travel board status file 212 as a list of travel boards in the system with background information about each. The background information such as location and phone number can be entered into the background files 214 about each travel board in the system via the keyboard 222. Each travel board on the list has a status indicator which corresponds to the operating condition of the board and also indicates whether the specific board has been flagged by the control program 210 for dialing on the next update cycle. The status of a travel board may be changed by the operator via the keyboard 222 or is changed by the control program 210 in response to a change to the road/lodging status files 216. The control program 10 may also update the status of a travel board to indicate that there are technical difficulties with communications to the board or that the board computer needs to be reset.

In addition to managing the flow of information between files, the control program also executes a routine update cycle to continuously update the travel boards by transferring information to the boards via the modems. FIG. 10 illustrates the update routine 250. The control program receives incoming calls from the modems in step 260. In step 270, based on the calls or on entries from the keyboard, the control program updates the road/lodging status files. The control program then flags those travel boards that are affected by the updates to the road/lodging status files for dialing on the next update cycle (step 280). In steps 290 and 295, the control program checks to see if it is time to execute the next update cycle or if an operator has indicated that a manual update cycle is desired. If either condition has been met, the travel boards flagged for dialing are contacted in step 300 and the information in the road/lodging status files is transferred to the affected travel display boards in step 305. All activity is logged in the log files in step 310. This process repeats continuously as long as the travel boards are in operation.

The database manager system may be implemented using an suitable software package or custom code. The illustrated embodiment utilizes the following software packages. The manager uses Secant Persistent Object Manager to serve as an interface between the manager and the files. An ODBC data connection is defined using Microsoft® Access driver. Greenleaf Comm++ is a set of libraries dealing with serial communications that is used by the manager to control the modems. Dialogic System Software are libraries and drivers that control the Dialogic voice board at the low level. Visual Voice Pro 3.03 is used by the manager to deal with incoming phone calls.

Figure 11:
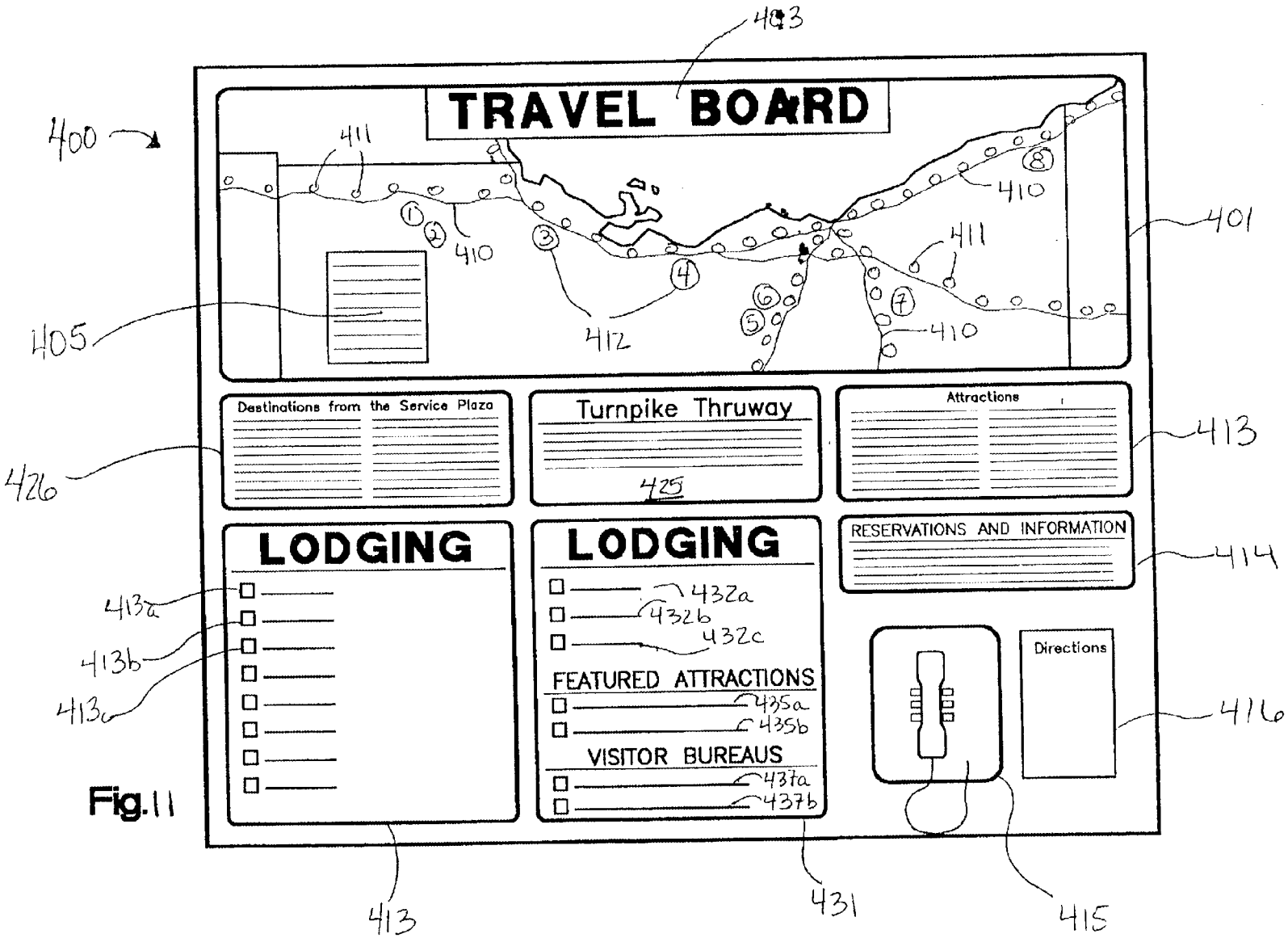

FIG. 11 depicts another embodiment of a travel board in accordance with the present invention. A travel board 400 features an electronic message center 403 which can display text. A large illuminated state/area map 401 depicts major roads 410 with road alert indicators 411 and lodging locations 412. A legend 405 is provided to help a traveler use the board. A set of general instructions for using the travel board are contained in the section indicated by reference character 414. An overview of the road in proximity to the travel board is located in board section 425.

A phone 415 is provided for traveler use in contacting lodgings and attractions described on the travel board. As already discussed, the phone may only be used to reach establishments which subscribe to the travel board service. Board section 416 contains specific instructions on using the phone 415. An attractions list 413 gives more detail on nearby attractions as well as their corresponding map identification numbers. The mileage between the service station and various points of interest is provided in section 426. A lodging list 412 provides the names and map identification number (also used for contacting the lodging with the phone 415) as well as specific information on the type of accommodations available at the given lodging in individual listings 413*a*–413*c*.

A highlight information listing 431 lists a selection of lodgings 432*a*–432*c* and attractions 435*a*–435*b* for view by the traveler. Visitors bureaus 437*a*–437*b* are also listed in the highlight information listing 431.

Although the invention has been described with a certain degree of particularity, it should be understood that those skilled in the art can make various changes to it without departing from the spirit or scope of the invention as hereinafter claimed.

We claim:

1. A method for operating a plurality of travel information display boards, said boards comprising structure defining a display board having a first section displaying the identity and locations of lodgings, status indicators associated with each of said lodgings, including at least two illumination conditions for indicating two discrete status levels, a map section on said display board for depicting a road map, said road map displaying the positions of said lodgings with road alert indicators positioned on said display along said roadway depicted on said map section having two illumination levels, means for accessing said display board from a remote location including a programmable computer including memory, an input means, and interface means for interfacing said computer to said indicators, a plurality of telephone lines including a telephone interface coupling said telephone line to said computer, means for recognizing commands issued by a caller on said phone line or by an operator on said input means for changing an illumination condition of a pre-selected lodging or road alert indicator from a first condition to a second condition comprising the steps of:

a) storing status information in said computer memory about said lodging and said road alert conditions in a travel condition file;

b) receiving updated information about said lodging and road alert conditions and weather conditions;

c) updating said stored status information in said travel condition file based upon said updated information;

d) maintaining a display board status file in said computer memory for identifying display boards that have indicator lights whose illumination levels need to be changed based on said updated status information; and e) contacting said identified display boards to transmit said updated information and change said illumination levels.

2. The method of claim 1 wherein the step of receiving updated information about said lodging and road alert conditions is performed by recognizing commands issued by said caller on said phone line.

3. The method of claim 1 wherein the step of receiving updated information about said lodging and road alert conditions is performed by recognizing commands issued by said operator on said input means.

4. The method of claim 1 wherein the step of contacting said identified display boards is performed automatically at predetermined intervals.

5. The method of claim 1 further comprising the step of storing information about operation of said travel display boards in a log file.

6. The method of claim 1 further comprising the step of storing information about individual lodging and said roadway in said computer memory for display to said operator.

7. An apparatus for operating a plurality of travel information display boards, said boards comprising structure defining a display board having a first section displaying the identity and locations of lodgings, status indicators associated with each of said lodgings, including at least two illumination conditions for indicating two discrete status levels, a map section on said display board for depicting a road map, said road map displaying the positions of said lodgings with road alert indicators positioned on said display along said roadway depicted on said map section having two illumination levels, means for accessing said display board from a remote location including a programmable computer including memory, an input means, and interface means for interfacing said computer to said indicators, a plurality of telephone lines including a telephone interface coupling said telephone line to said computer, means for recognizing commands issued by a caller on said phone line or by an operator on said input means for changing an illumination condition of a pre-selected lodging or road alert indicator from a first condition to a second condition comprising the steps of:

a) means for storing status information in said computer memory about said lodging and said road alert conditions in a travel condition file;

b) means for receiving updated information about said lodging and road alert conditions;

c) means for receiving weather information updates for display on said display boards;

d) means for updating said stored status information in said travel condition file based upon said updated information;

e) means for maintaining a display board status file in said computer memory for identifying display boards that have indicator lights whose illumination levels need to be changed based on said updated status information; and f) means for contacting said identified display boards to transmit said updated information and change said illumination levels.

8. The apparatus of claim 7 wherein the means for receiving updated information about said lodging and road alert conditions recognizes commands issued by said caller on said phone line.

9. The apparatus of claim 7 wherein the means for receiving updated information about said lodging and road alert conditions recognizes commands issued by said operator on said input means.

10. The apparatus of claim 7 wherein the means for contacting said identified display boards contacts said boards automatically at predetermined intervals.

11. The apparatus of claim 7 further comprising means for storing information about operation of said travel display boards in a log file.

12. The method of claim 7 further comprising means for storing information about individual lodging and said roadway in said computer memory for display to said operator.

13. A computer readable medium having computer-executable instructions for operating a plurality of travel information display boards, said boards comprising structure defining a display board having a first section displaying the identity and locations of lodgings, status indicators associated with each of said lodgings, including at least two illumination conditions for indicating two discrete status levels, a map section on said display board for depicting a road map, said road map displaying the positions of said lodgings with road alert indicators positioned on said display along said roadway depicted on said map section having two illumination levels, means for accessing said display board from a remote location including a programmable computer including memory, an input means, and interface means for interfacing said computer to said indicators, a plurality of telephone lines including a telephone interface coupling said telephone line to said computer, means for recognizing commands issued by a caller on said phone line or by an operator on said input means for changing an illumination condition of a pre-selected lodging or road alert indicator from a first condition to a second condition comprising the steps of:

a) storing status information in said computer memory about said lodging and said road alert conditions in a travel condition file;

b) receiving updated information about said lodging and road alert conditions and weather conditions;

c) updating said stored status information in said travel condition file based upon said updated information;

d) maintaining a display board status file in said computer memory for identifying display boards that have indicator lights whose illumination levels need to be changed based on said updated status information; and e) contacting said identified display boards to transmit said updated information and change said illumination levels.

14. An information display board system, comprising:

a) structure defining a display board having a first section displaying the identity and locations of motels/hotels and other lodgings;

b) status indicators associated with each of said hotels/motels or other lodgings, including at least two illumination conditions for indicating two discrete status levels;

c) means for accessing said display board from a remote location including:

i) a programmable computer including interface means for interfacing said computer to said indicators;

ii) a telephone line including a telephone interface coupling said telephone line to said computer;

iii) means for recognizing commands issued by a caller on said phone line for changing an illumination condition of a pre-selected indicator from a first condition to a second condition;

d) a second phone line interfaced to said computer via a modem;

e) said system being further operative to receive data along said second phone line for changing a hotel/motel and said road alert indicators code file stored within said computer;

f) means for transmitting display board information to a remote location along said second phone line;

g) an enunciating device operative to receive signals from said computer when said phone line is active which are translated to audio messages heard by a caller;

h) a touch sensitive screen responsive to a user's touch of said screen providing visual information regarding a selected subject area; and, i) means for downloading weather condition data from an on-line service and displaying said data at said display board system.

* * * * *